US005898647A

United States Patent [19]

Goradesky

[11] Patent Number: 5,898,647

[45] Date of Patent: Apr. 27, 1999

[54] ALTERNATE CARRIER FOR A WRIST INSTRUMENT

[75] Inventor: Harold S. Goradesky, Miami Beach, Fla.

[73] Assignee: Timex Corporation, Middlebury, Conn.

[21] Appl. No.: 08/968,104

[22] Filed: Nov. 12, 1997

[51] Int. Cl.[6] ..... G04B 37/00

[52] U.S. Cl. ..... 368/83; 368/86

[58] Field of Search ..... 368/88, 281, 283, 368/286; 224/152

[56] References Cited

U.S. PATENT DOCUMENTS

| | | | |
|---|---|---|---|
| 949,364 | 2/1910 | Porter | 368/283 |
| 1,309,988 | 7/1919 | Knyvett | 368/283 |
| 1,986,328 | 1/1935 | Dreyfus | 368/283 |
| 2,635,416 | 4/1953 | Mieschen | 368/283 |
| 3,740,944 | 6/1973 | Choparo | 368/286 |
| 3,777,953 | 12/1973 | Lewis | 368/286 |

*Primary Examiner*—Vit W. Miska
*Attorney, Agent, or Firm*—Arthur G. Schaier

[57] ABSTRACT

A carrier for a wrist instrument when it is removed from the wrist band comprises a case made in two pieces of identical construction which slide together and house the wrist instrument and its attachments. The two carrier sections each have a tongue extending across a parting line which is received in a mating channel on the other carrier section. Additional guide pins and recesses hold the assembly in alignment. A holster for the assembled carrier sections cradles the assembly securely and includes a belt clip for attaching the holster to a belt.

10 Claims, 8 Drawing Sheets

ALTERNATE CARRIER FOR A WRIST INSTRUMENT

TECHNICAL FIELD

This invention relates generally to carrying cases or holsters, and more particularly to an alternate carrier for a wrist instrument.

BACKGROUND ART

There are many types of wrist instruments known in the art which usually have a display or dial in the center of the case with side attachments to be connected to a wrist band or strap encircling the wrist. Wrist instruments are usually timepieces, but may also include rather large electronic multi-function devices such as personal digital assistants or pagers. While they are designed to be worn on the wrist, there are times when it would be desirable to have an alternate means to transport the wrist instrument in a separate bag or purse or attach to a belt or other article of clothing.

Belt attached carrying cases are known in the art for carrying pocket watches in a leather holster with the display exposed for viewing, the holster being attached to a loop designed to be attached to a waistband or belt.

Exemplary of patents disclosing devices to mount an ordinary wristwatch on a belt are U.S. Pat. No. 4,326,280 issued Apr. 20, 1982 to Perry, and U.S. Pat. No. 5,106,004 issued Apr. 21, 1992 to Nguyen.

The lugs or attachments on a wristwatch which connect to the watch strap using springbars or other means of connection are particularly designed for this purpose. If the watch strap is removed and the wrist instrument is carried separately in a pocket or purse, the attachments are apt to catch on loose threads or fabric and cause damage. It would be desirable to have a carrying case for the wrist instrument allowing it to be easily handled when the strap is not attached, and to protect against injury or damage caused by the attachments. It would also be desirable to include a holster for the carrying case enabling the wrist instrument to be removed and observed and then returned to a secure carrying position.

One object of the invention is to provide a carrying case for a wrist instrument to be used when the wrist band has been removed.

Another object of the invention is to provide an improved carrier and belt holder for a wrist instrument.

DISCLOSURE OF INVENTION

Briefly stated, the invention is practiced by providing an alternate carrier for a wrist instrument of the type having a case with a display on the front, actuating buttons on the case and first and second wrist attachments on opposite ends of the case extending outwardly from the display and adapted for attachment to the ends of a wrist band or the like. The carrier comprises a top carrier section having a first wall defining a first pocket shaped to receive and sheath portions of the case and the first wrist attachment, a bottom carrier section having a second wall defining a second pocket shaped to receive and sheath portions of the case and the second wrist attachment, the top and bottom carrier sections being separably connected together with portions of the first and second walls meeting along a parting line with the first and second pockets opposing one another so as to retain the case of the wrist instrument and the first and second wrist attachments housed in said pockets, the walls together defining a first opening exposing the display and actuating buttons, and retaining means for locking the top carrier section to the bottom carrier section to retain the case, while permitting a separation of the top carrier section from the bottom carrier section sufficient to remove the case.

Preferably the top and bottom carrier sections are of identical construction, each having a tongue extending beyond the parting line, and each having a channel receiving an identical tongue extending from the opposite member. A belt holster includes a clip for attachment to a belt, and a third pocket shaped to receive and sheath portions of the joined top and bottom carrier sections and adapted to assist said retaining means in locking the top carrier section to the bottom carrier section.

BRIEF DESCRIPTION OF THE DRAWINGS

The invention will better be understood by reference to the following description, taken in connection with the accompanying drawings, in which.

BEST MODE FOR CARRYING OUT THE INVENTION

Figure 1:
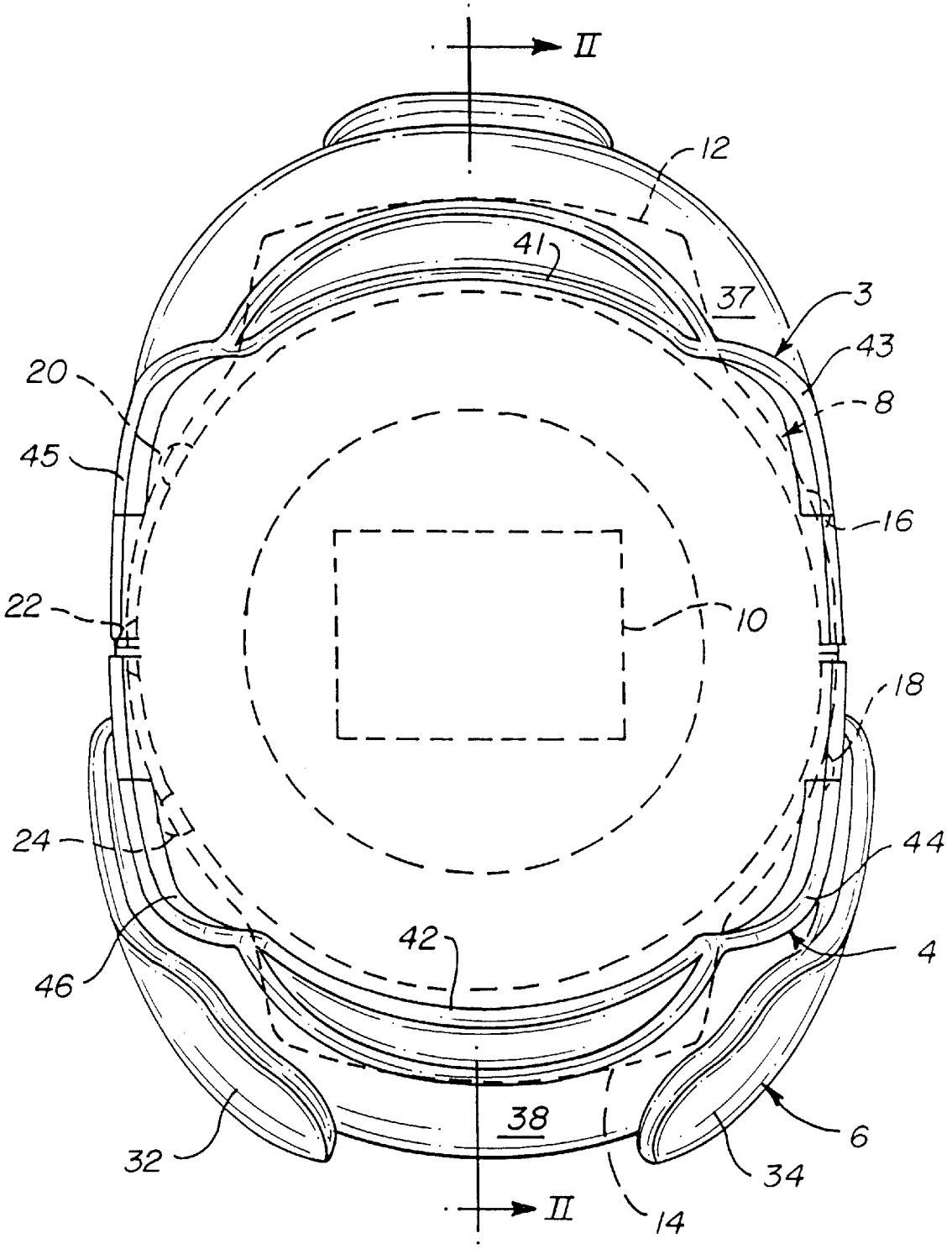
FIG. 1 is a top plan view of the assembled carrier and belt holster with a wrist instrument shown in dotted lines.

Referring to FIG. 1 of the drawing, the top plan view illustrates carrier and holster for a wrist instrument, which is shown in phantom lines, since it is not part of the present invention. The carrier comprises an assembly of a top carrier section 3 and a bottom carrier section 4 held within a belt holster 6, and is intended to hold a wrist instrument shown generally at 8 in phantom lines. The wrist instrument comprises a case 8 having a display 10 and a wrist attachment 12 on one side of display 10 and another wrist attachment 14 on the other side of display 10. The wrist strap has been removed from the attachments 12, 14. Pushbutton actuators 16, 18 protrude from one side of case 8 and actuators 20, 22, 24 protrude on the other side of case 8. The type of wrist instrument is immaterial, but it is contemplated that the invention would be used with a wristwatch pager, since a wristwatch pager is generally larger and bulkier than an ordinary wristwatch.

Figure 2:
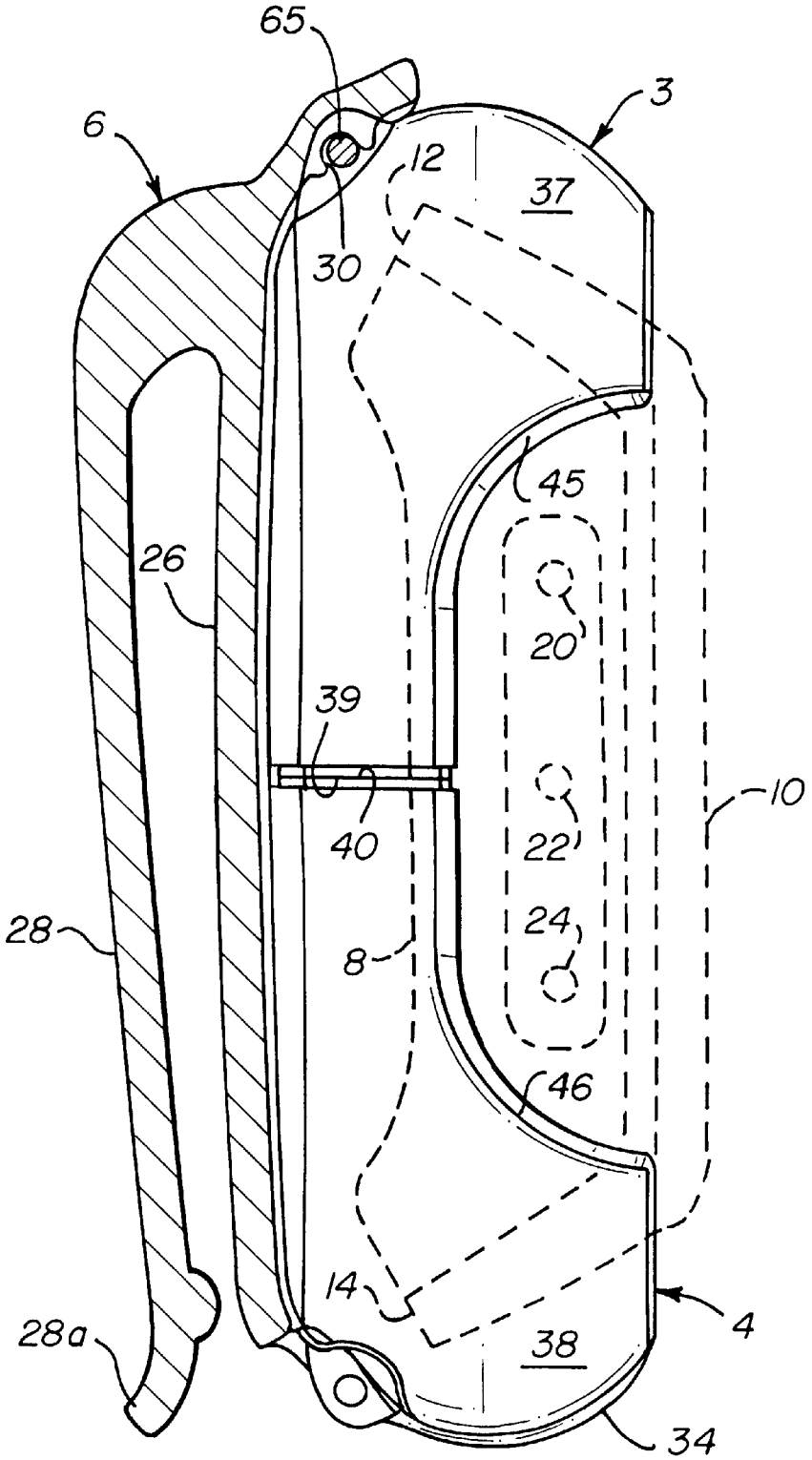
FIG. 2 is a side elevational view of the carrier and holster shown in FIG. 1, with the holster shown in cross section taken along lines II—II of FIG. 1.

Referring to FIG. 2, the cross section illustrates that the belt holster 6 in its central section (section lines II—II) includes a back wall 26 joined to a spring clip 28 with a flared end 28*a* adapted to slip over the top of a belt or waistband. The central wall 26 and spring clip 28 join together at one end and define a small notch 30, which cooperates with the carrier assembly in a manner to be described. At the opposite end of the carrier holster, the central wall 26 branches and forms two contoured holster pads 32, 34 as shown in the plan view of FIG. 1, which enfold opposite sides of the bottom carrier section 4.

Referring again to FIG. 2, the two carrier sections 3 and 4, top carrier section 3 includes a contoured wall 37 defining a pocket which receives attachment 12 and portions of case 8 of the wrist instrument. Similarly, the bottom carrier section 4 defines a contoured wall 38 defining a pocket receiving the attachment 14 and portions of case 8. Walls 37 and 38 meet along a parting line, at respective edges 39 and 40. The walls 37 and 38 further define respective mutually opposing top edges 41 and 42, which surround the periphery and display 10 of the wrist instrument, so that display 10 can be read. The walls also dip down on either side at 43, 44, 45 and 46, so that actuators 16, 18, 20, 22, 24 can be operated while the wrist instrument is housed and sheathed in the carrier.

Figure 3:
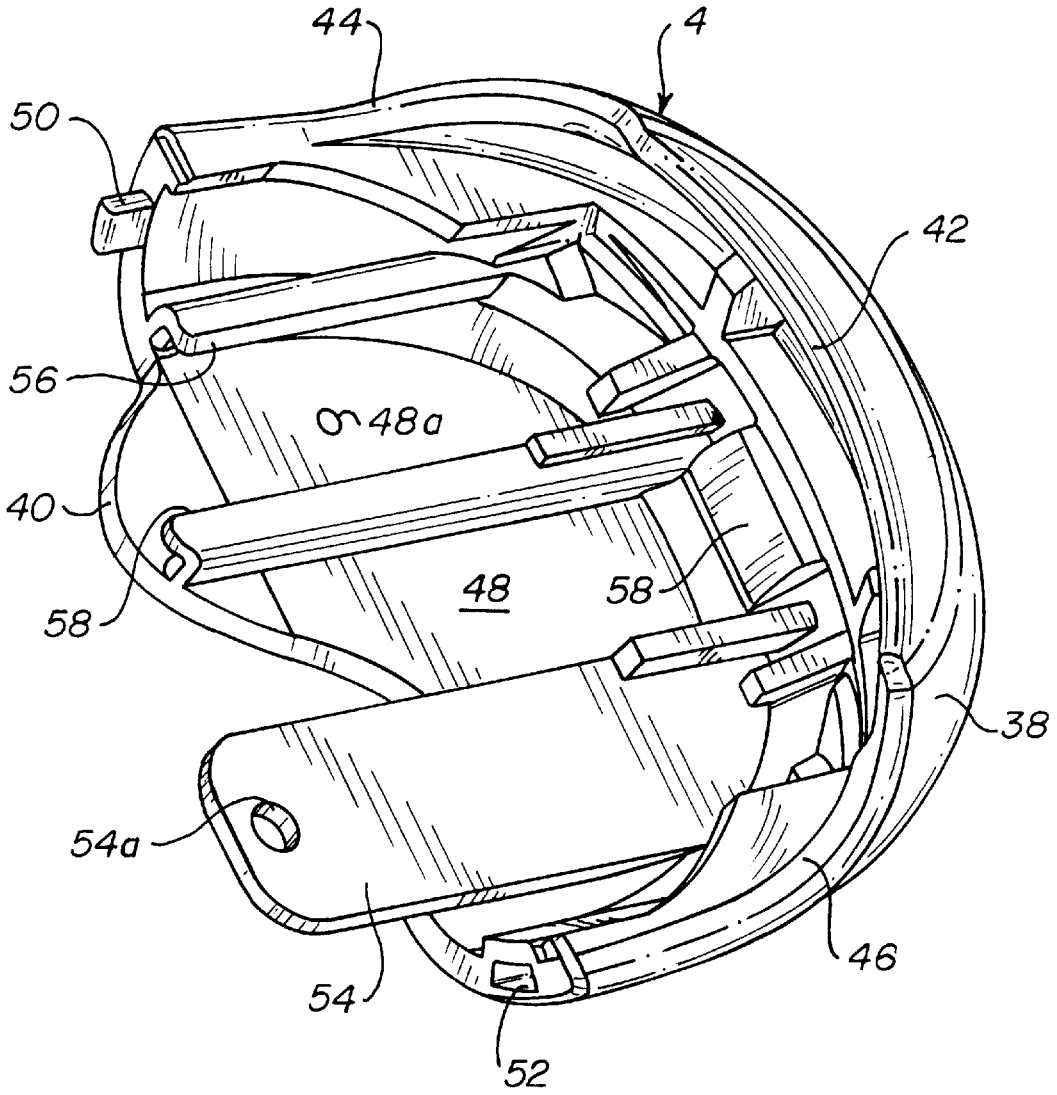
FIG. 3 is a top/left side perspective view of the bottom carrier section, (the top carrier section being substantially identical)
Figure 4:
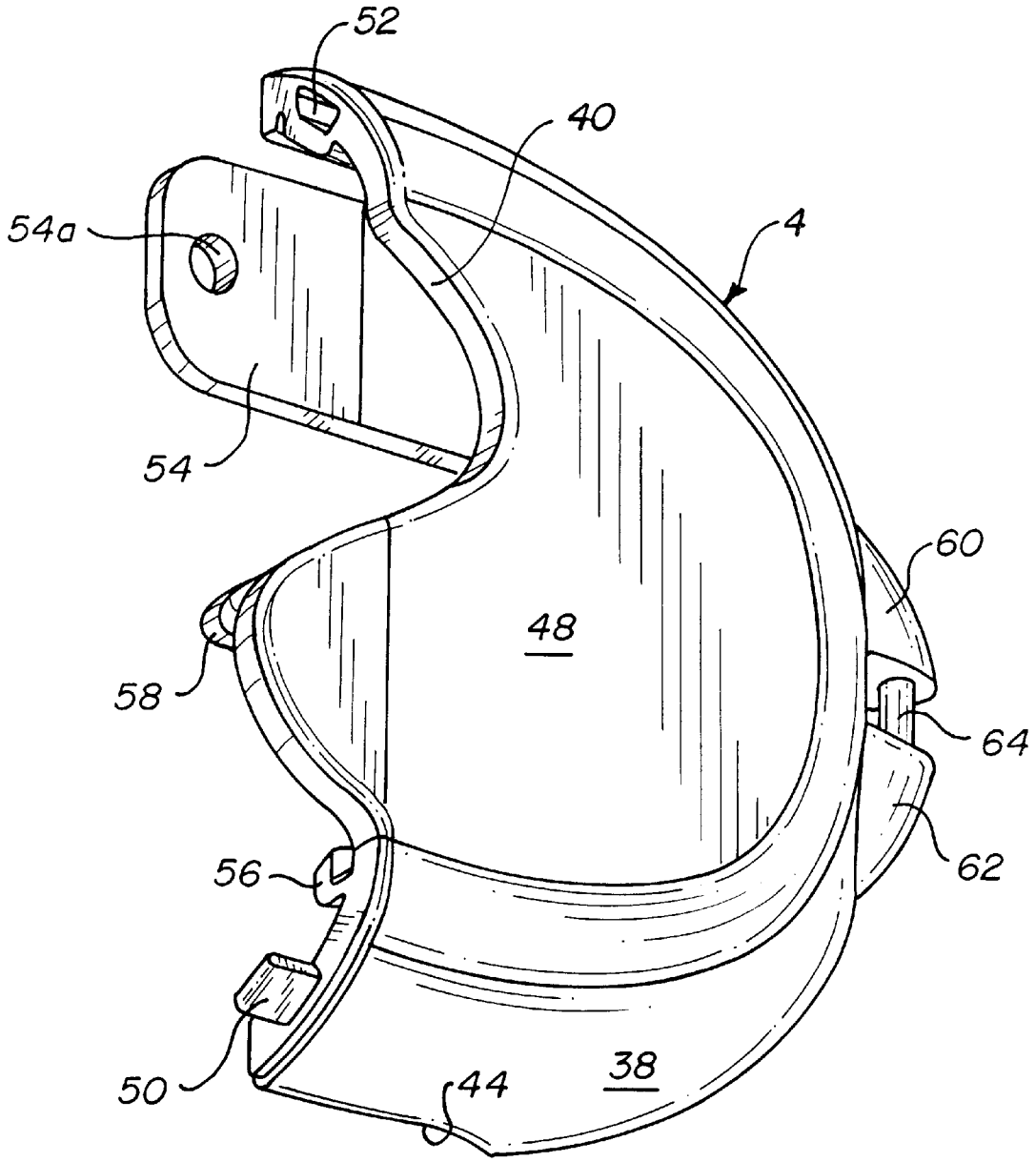
FIG. 4 is a bottom/right perspective view of the bottom carrier section of FIG. 3, (the top carrier section being substantially identical)

Referring now to FIG. 3 and FIG. 4 of the drawing, top and bottom perspective views may be seen of the bottom carrier section 4, which is designed to be identical in construction to the top carrier section 3. Therefore only the bottom carrier section 4 will be described in detail.

As seen in FIG. 3, the wall 38 terminates along the edge cutout sections 44, 46 joined across the top by edge 42 and joins with a flat wall 48. The wall 48 extends across the bottom to terminate in an S-shaped parting line edge 40. Walls 38, 48 together define a pocket which receives and sheaths one end of the wrist instrument case together with its attachment.

A guide pin 50 extends from one side of the parting line edge 40 and a guide receptacle 52 of a similar shape and cross section is molded into the other side of parting line edge 40. A flat tongue 54 extends above the bottom wall 48 for a short distance beyond the parting line 40. A hole 54*a* in the end of the tongue 54 provides a retaining means, as will be described.

On the other side of the carrier, a channel is provided by means of two L-shaped projections 56, 58, together defining a channel corresponding to the shape of tongue 54. A dimple 48*a* protrudes from bottom wall 48. Additional molded sections, such as boss 58 provide reinforcement.

As seen in FIG. 4 depicting the opposite side of the bottom carrier section 4, a pair of pin supports 60, 62 extend from the aforesaid reinforcing boss 48 and are spaced apart to support a metal pin 64. The bottom carrier section 4 is preferably injection molded of a blend of ABS and polycarbonate plastic. The pin 64 may be overmolded in place during the injection molding process, and provides an external attachment for a carrying cord or chain.

Figure 5:
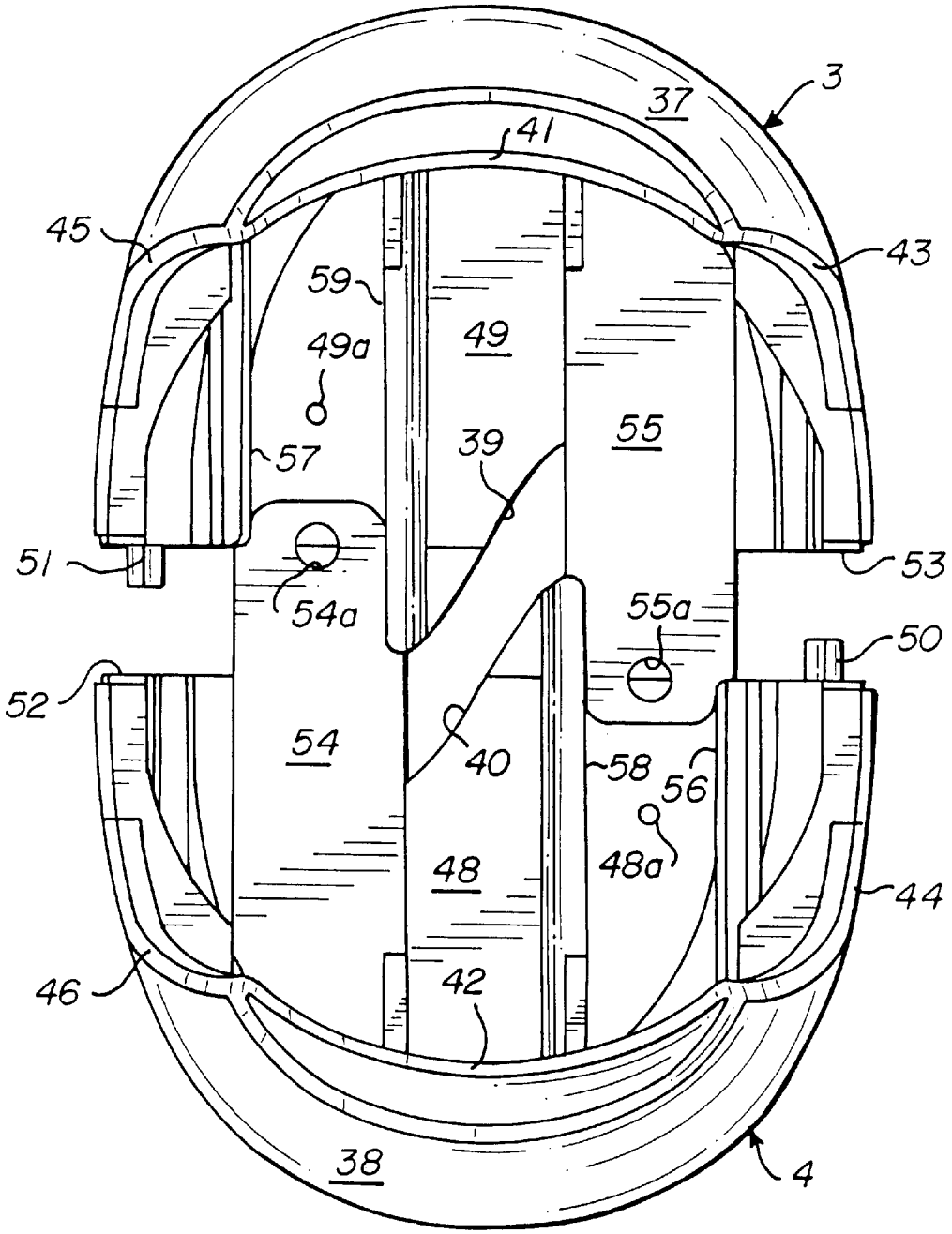
FIG. 5 is a top plan view of top and bottom carrier sections partially assembled.
Figure 6:
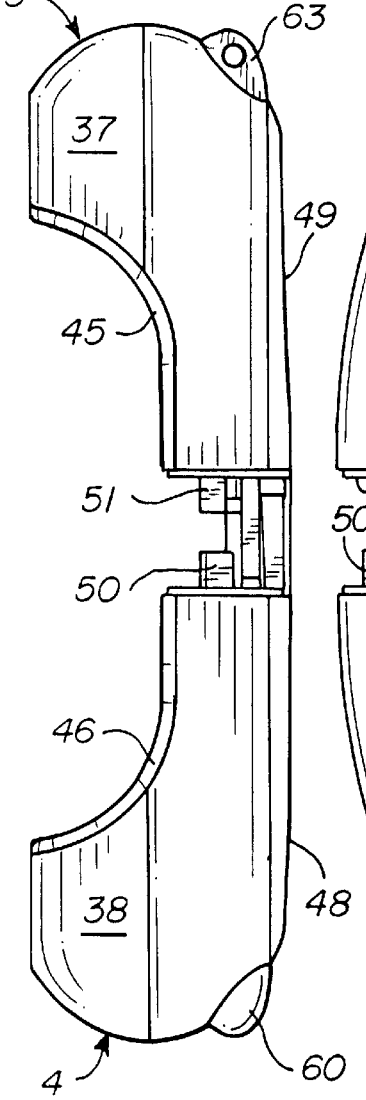
FIG. 6 is a side elevational view of top and bottom carrier sections partially assembled.
Figure 7:
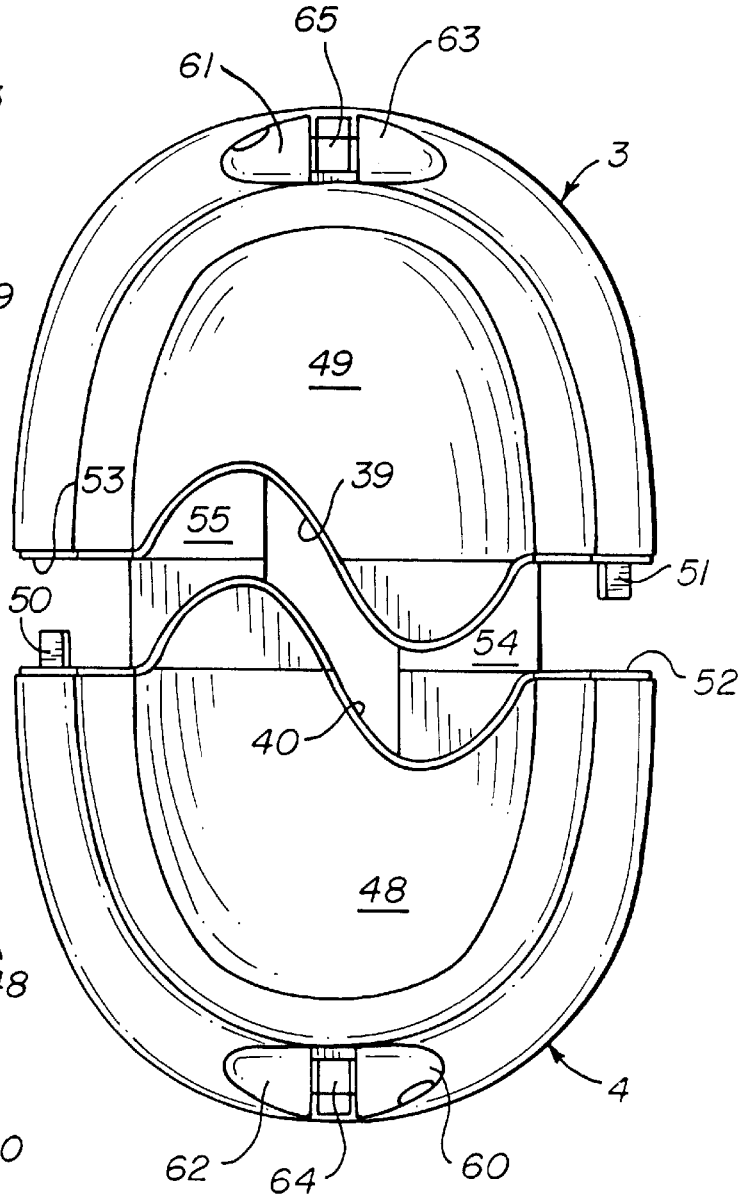
FIG. 7 is a bottom plan view of top and bottom carrier sections partially assembled.

Referring to FIGS. 5, 6 and 7, it is seen that identical parts may be used for the top and bottom carrier sections. Identical members or elements corresponding to those of the bottom carrier section 4 are found in the top carrier section 3 as follows, using odd numbers for reference numbers. An S-shaped parting line 39 exactly matches the shape of the parting line 40. A guide pin 51 and a guide recess 53 correspond to the aforementioned guide pin 50 and recess 52 in the bottom carrier section. A tongue extension 55 with hole 55*a* corresponds to tongue extension 54 in the bottom carrier section. L-shaped extensions 57, 59 correspond to extensions 56, 58 respectively in the bottom carrier section providing a channel with a projecting dimple 49*a* in a bottom floor 49 of the top carrier section. All of the aforementioned odd reference elements of the top carrier sections are mirror images of the even reference elements of the bottom carrier section 4, so that they mate exactly and slide together as indicated in FIGS. 5, 6 and 7. The holes 54*a*, 55*a* slide over and receive dimples 48*a*, 49*a* respectively to retain the top carrier section to the bottom carrier section, yet permit separation so that the watch case may be inserted as shown in the assembly drawing.

Figure 8:
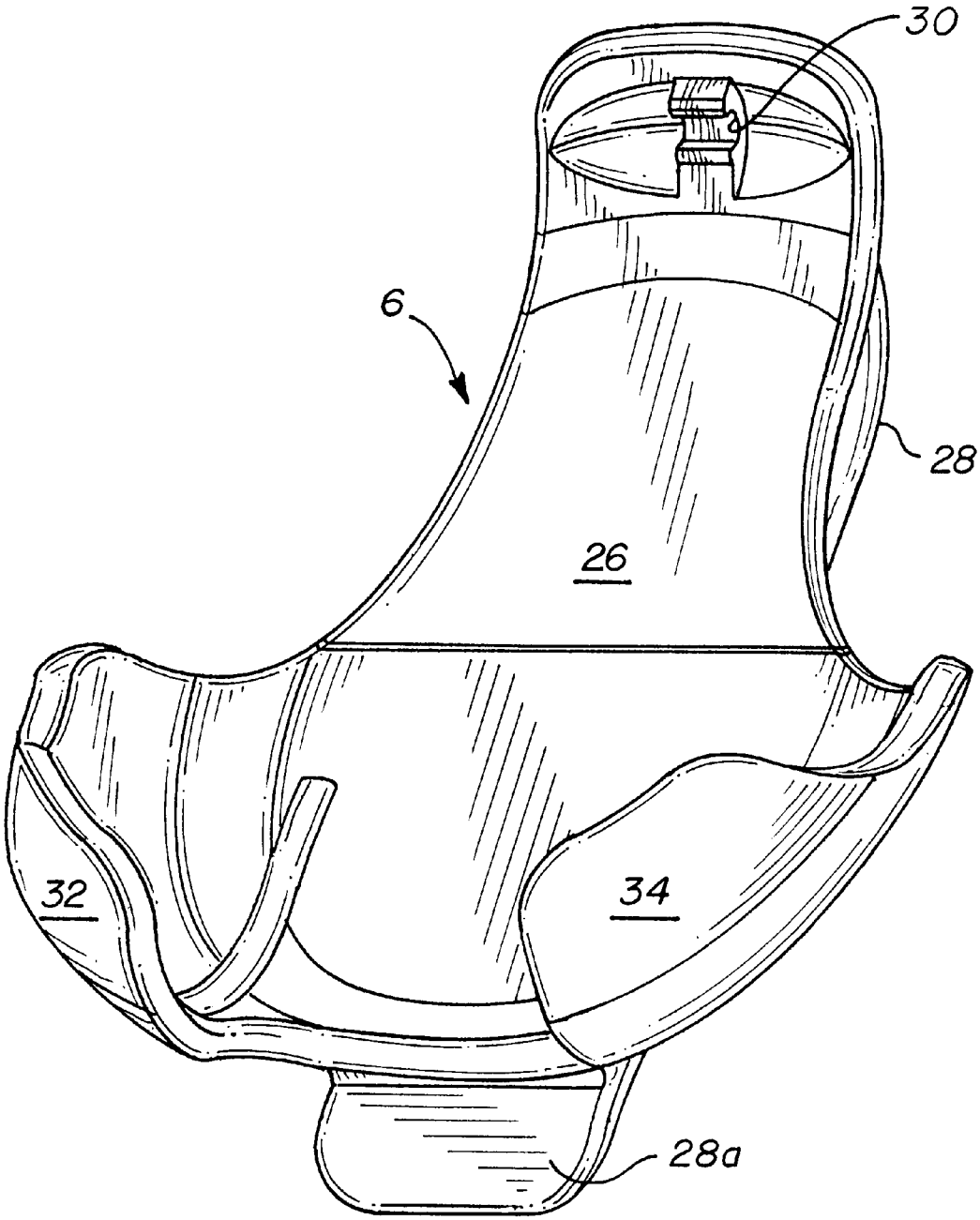
FIG. 8 is a front/right side perspective view of the belt holster.
Figure 9:
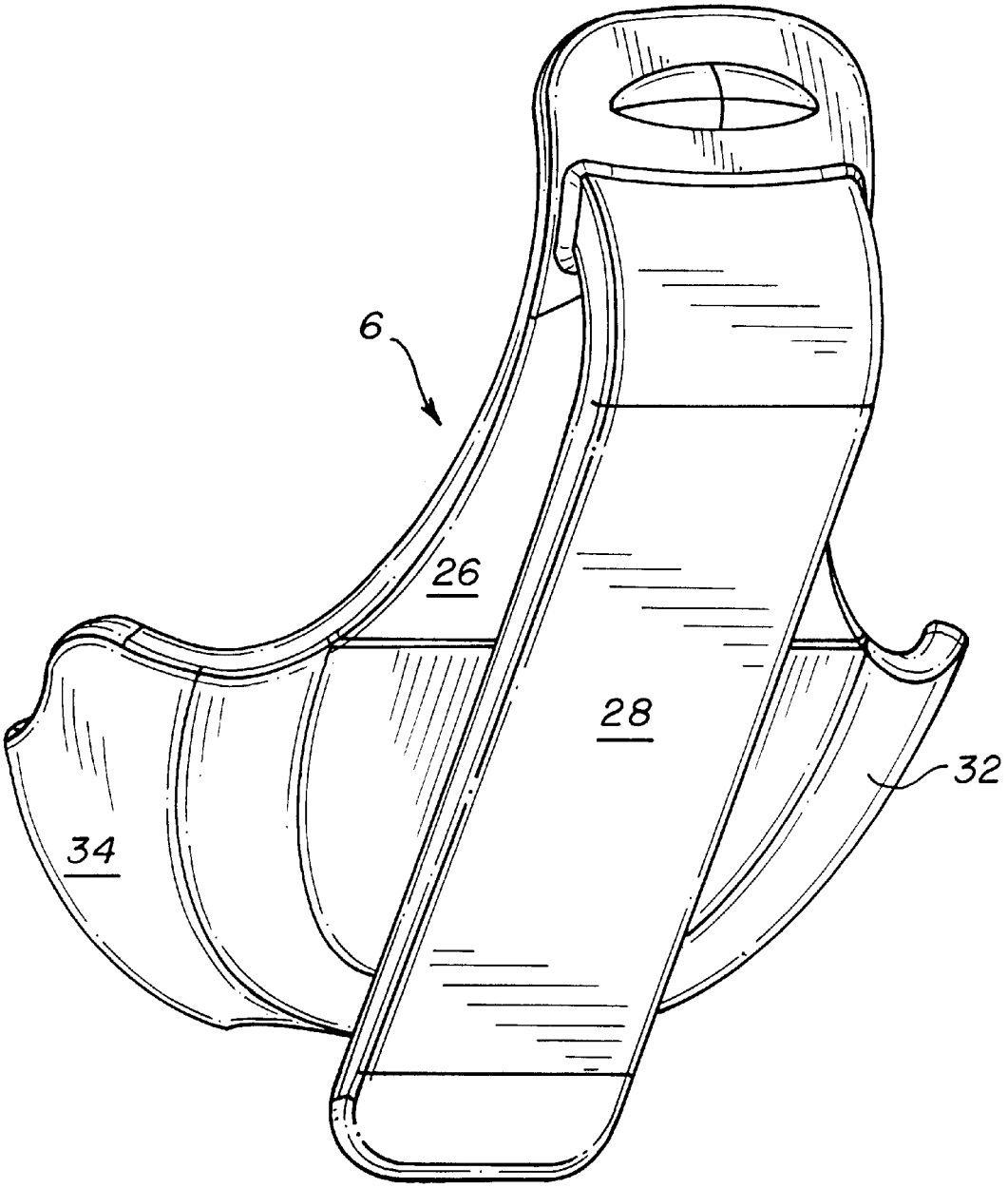
FIG. 9 is a rear/left side perspective view of the belt holster.

Referring to FIGS. 8 and 9, the details of the belt holster 6 are shown. In the plan view of FIG. 8, the central bottom wall 26 is shown branching to form the two holster pads 32, 34. The slot 30 at the opposite end of central wall 26 receives the steel pin 65 of the top carrier section (see FIG. 2). The two holster pads 32, 34 are so proportioned and sufficiently resilient that they provide a spring force to hold the two carrier sections securely together and to hold the carrier assembly in the holster. Since the two ends of the assembled carrier are identical, it can be inserted into the belt holster 6 in either direction, there being a steel pin 64 located at the same location on the other end opposite pin 65.

FIG. 9 indicates the resilient spring clip 28 which may be slipped over a belt to hold the holster in place. If the holster is not desired, a chain or cord may be placed around the pin 65, so that the carrier assembly may be carried as a unit in a pocket or purse without the belt holster 6.

While there has been described what is considered to be the preferred embodiment of the invention, other modifications will occur to those skilled in the art, and it is desired to secure in the appended claims all such modifications as fall within the true spirit and scope of the invention.

I claim:

1. An alternate carrier for a wrist instrument, the wrist instrument having a case with a display on the front thereof, actuating buttons on the case and first and second wrist attachments on opposite ends of the case extending outwardly from the display and adapted for attachment to the ends of a wristband or the like, said carrier comprising:

a top carrier section having a first wall defining a first pocket shaped to receive and sheath portions of the case and the first wrist attachment, a bottom carrier section having a second wall defining a second pocket shaped to receive and sheath portions of the case and the second wrist attachment, the top and bottom carrier sections being separably connected together with portions of the first and second walls meeting along a parting line with the first and second pockets opposing one another so as to retain the wrist instrument case and the first and second wrist attachments in said pockets, said walls together defining a first opening exposing the display and actuating buttons, and retaining means for locking the top carrier section to the bottom carrier section to retain the case while permitting a separation of the top carrier section from the bottom carrier section sufficient to remove the case.

2. The combination according to claim 1, wherein said top and bottom carrier sections are of identical construction.

3. The combination according to claim 1, wherein said retaining means comprises a tongue on at least one of the carrier sections extending beyond the parting line and a channel defined in the other carrier section adapted to receive said tongue, said tongue and channel defining cooperative engaging elements for holding said tongue in said channel when the first and second walls meet along the parting line.

4. The combination according to claim 1, wherein each of said carrier sections has a parting line edge defining said parting line when the perspective parting line edges are joined.

5. The combination according to claim 1, wherein at least one of said carrier sections includes a guide pin projecting from the parting line edge and the other carrier section includes a recess defined in the parting line edge of said other carrier section adapted to receive said guide pin.

6. The combination according to claim 1, wherein said top and bottom carrier sections are of identical construction, each of the carrier sections having a tongue extending beyond the parting line and the other of the carrier sections defining a channel adapted to receive said tongue.

7. The combination according to claim 1, wherein at least one of said carrier sections defines an end portion having a metal pin embedded on both ends thereof providing an exterior attachment for the carrier.

8. The combination according to claim 1, and further including a belt holster defining a third pocket adapted to receive one of the carrier sections therein and having a clip extending from the belt holster on the other side of said third pocket arranged to support the holster from a belt.

9. The combination according to claim 8, wherein said third pocket comprises a pair of contoured pads adapted to receive the bottom carrier section.

10. The combination according to claim 8, wherein the exterior of the top carrier section includes a metal pin embedded on either end thereof adapted to serve as an external attachment, and wherein said belt holster defines a cooperating recess adapted to receive said metal pin when the bottom carrier section is disposed in said third pocket.

* * * * *